US009804630B2

(12) United States Patent
Kondo

(10) Patent No.: US 9,804,630 B2
(45) Date of Patent: Oct. 31, 2017

(54) ADJUSTABLE REFERENCE CURRENT GENERATOR, SEMICONDUCTOR DEVICE AND ADJUSTABLE REFERENCE CURRENT GENERATING METHOD

(71) Applicant: LAPIS Semiconductor Co., Ltd., Yokohama (JP)

(72) Inventor: Mamoru Kondo, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 15/054,650

(22) Filed: Feb. 26, 2016

(65) Prior Publication Data

US 2016/0252925 A1 Sep. 1, 2016

(30) Foreign Application Priority Data

Feb. 27, 2015 (JP) ..... 2015-038546

(51) Int. Cl.
*G05F 3/26* (2006.01)
*G05F 3/08* (2006.01)
*G05F 1/46* (2006.01)

(52) U.S. Cl.
CPC ..... *G05F 3/262* (2013.01); *G05F 1/46* (2013.01); *G05F 3/08* (2013.01)

(58) Field of Classification Search
CPC . G05F 1/46; G05F 1/465; G05F 1/561; G05F 3/262; G05F 3/26; G05F 1/10; G05F 3/08; G05F 3/02; G05F 3/242; G05F 3/247
See application file for complete search history.

(56) References Cited

U.S. PATENT DOCUMENTS

2008/0231249 A1* 9/2008 Barrow ..... G05F 3/262 323/315
2011/0273231 A1* 11/2011 Nakamura ..... G05F 3/262 330/257
2012/0075007 A1* 3/2012 Watanabe ..... G05F 3/262 327/534

(Continued)

FOREIGN PATENT DOCUMENTS

JP 2010-278854 A 12/2010

*Primary Examiner* — Gustavo Rosario Benitez
(74) *Attorney, Agent, or Firm* — Rabin & Berdo, P.C.

(57) ABSTRACT

A reference current generation part receives an adjustment signal representing a target current and generates a reference current having a current value which is corresponding to the adjustment signal. A detection current generation part generates a detection current having a current value which is m (where the m denotes 1 or more) times as large as a current value of the reference current. A detection voltage generation part with a first resistor generates a detection voltage having a voltage value corresponding to a voltage drop across the first resistor in response to a supply of the detection current. A monitor voltage generation part with a second resistor having a resistance value which is 1/n (where the n denotes greater than 1) times as large as a resistance value of the first resistor, and for generating a monitor voltage having a voltage value which is corresponding to a voltage drop across the second resistor in response to a monitor current supplied from outside of the adjustable reference current generator.

12 Claims, 6 Drawing Sheets

(56) References Cited

U.S. PATENT DOCUMENTS

| | | | | |
|---|---|---|---|---|
| 2013/0141006 | A1* | 6/2013 | Li | G05F 3/08 315/291 |
| 2013/0321068 | A1* | 12/2013 | Castagna | G05F 1/468 327/536 |
| 2014/0049234 | A1* | 2/2014 | Park | G05F 1/575 323/265 |
| 2016/0094195 | A1* | 3/2016 | Du | H03F 1/0233 330/254 |
| 2016/0239029 | A1* | 8/2016 | Ideno | H02H 9/04 |

* cited by examiner

| AD[j-1:0] | D[k-1:0] |
|---|---|
| 0000···0000 | 000···001 |
| 0000···0001 | 000···010 |
| 0000···0010 | 000···100 |
| ⋮ | ⋮ |
| 1111···1110 | 010···000 |
| 1111···1111 | 100···000 |

ADJUSTABLE REFERENCE CURRENT GENERATOR, SEMICONDUCTOR DEVICE AND ADJUSTABLE REFERENCE CURRENT GENERATING METHOD

BACKGROUND OF THE INVENTION

1. Field of the Invention

The present invention relates to an adjustable reference current generator, a semiconductor device including an adjustable reference current generator and an adjustable reference current generating method.

2. Description of the Related Art

In recent years, with the spread of mobile devices, it is desired to prolong life of batteries. Therefore, it is an important technical target to lower a power consumption rate of components of the mobile devices in order to lower a power consumption rate of the respective mobile devices. For example, such mobile devices includes a reference current generator which generates a minute electric current of nA (nanoampere: 10^-9 A) order. The reference current generator is formed in a semiconductor integrated circuit such as CMOS (Complementary Metal Oxide Semiconductor) LSI.

Since such a reference current generator is subjected to variations in its characteristics caused within manufacturing process thereof. Since variations in characteristics of the reference current generator is large, it is required to adjust an instantaneous value of the reference current while measuring the instantaneous current value of the reference current. Measurement is performed after converting a current value into a voltage value. For example, a voltage having a voltage value corresponding to a current value is generated by connecting a constant current source and a diode-connected transistor and by outputting a partial pressure. (For example, Japanese patent application Laid-Open No. 2010-278854).

SUMMARY OF THE INVENTION

When measuring a current value after converting a current value into a voltage value, variation occurs in a resistance value of a part which converts a current value into a voltage value (in the following, it referred to as a detection voltage generator), by environmental conditions such as temperature at the time of measurement. Therefore, to obtain a resistance value, measurement of the generated voltage is performed, for example, by supplying the detection voltage generation part with a current having a predetermined current value from outside of the semiconductor device. However, if a resistance value of the detection voltage generation part is large, it is required to supply a very small current for obtaining a voltage value in a predetermined range which is suitable for the voltage measurement. Therefore, it is difficult to precisely obtain a preferred current value by changing the actual resistance value.

When measuring a small current value of nA order, it is difficult to convert a current value into a voltage value accurately because of deviations of actual characteristics from the nominal ones of elements in a circuit. Therefore, it is difficult to measure and adjust an actual value of the reference current accurately.

It is therefore an object of the present invention to provide an adjustable reference current generator capable of adjustment of a current value with measuring a resistance value of a detection voltage generation part and a current value of a reference current easily and accurately, and to provide a semiconductor device including such an adjustable reference current generator.

An adjustable reference current generator according to the present invention comprises:

a reference current generation part for receiving an adjustment signal representing a target current and generating a reference current having a current value which is corresponding to the adjustment signal, a detection current generation part for generating a detection current having a current value which is m (where the m denotes 1 or more) times as large as a current value of the reference current, a detection voltage generation part with a first resistor for generating a detection voltage having a voltage value which is corresponding to a voltage drop across the first resistor in response to a supply of the detection current, a monitor voltage generation part with a second resistor having a resistance value which is 1/n (where the n denotes greater than 1) times as large as a resistance value of the first resistor, and for generating a monitor voltage having a voltage value which is corresponding to a voltage drop across the second resistor in response to a monitor current supplied from outside of the adjustable reference current generator.

Further, the semiconductor device according to the present invention comprises an adjustable reference current generator, wherein the adjustable reference current generator comprises:

a reference current generation part for receiving an adjustment signal representing a target current and generating a reference current having a current value which is corresponding to the adjustment signal, a detection current generation part for generating a detection current having a current value which is m (where the m denotes 1 or more) times as large as a current value of the reference current, a detection voltage generation part with a first resistor for generating a detection voltage having a voltage value which is corresponding to a voltage drop across the first resistor in response to a supply of the detection current, a monitor voltage generation part with a second resistor having a resistance value which is 1/n (where the n denotes greater than 1) times as large as a resistance value of the first resistor for generating a monitor voltage having a voltage value which is corresponding to a voltage drop across the second resistor in response to a monitor current supplied from outside of the adjustable reference current generator.

Further, the adjustable reference current generating method comprises the steps of:

receiving an adjustment signal representing a target current and generating a reference current having a current value which is corresponding to the adjustment signal;

generating a detection current having a current value which is m (where the m denotes 1 or more) times as large as a current value of the reference current;

generating a detection voltage having a voltage value which is corresponding to a voltage drop across a first resistor in response to a supply of the detection current;

obtaining a resistance value of a monitor resistor having a resistance which is at n:1 (where the n denotes larger than 1) resistance ratio against a detection voltage generation part which generates the detection voltage; and obtaining a resistance value of the detection voltage generation part on the basis of the resistance value of the monitor resistor.

According to the present invention, it is possible to adjust the reference current while measuring a resistance value of a detection voltage generation part and a current value of a reference current easily and accurately.

BRIEF DESCRIPTION OF THE DRAWINGS

Some aspects and other features of the present invention are explained in the following description, taken in connection with the accompanying drawing figures wherein.

DETAILED DESCRIPTION OF THE INVENTION

Embodiments of the present invention will be described in detail with reference to the accompanying drawings hereinbelow.

Example 1

Figure 1:
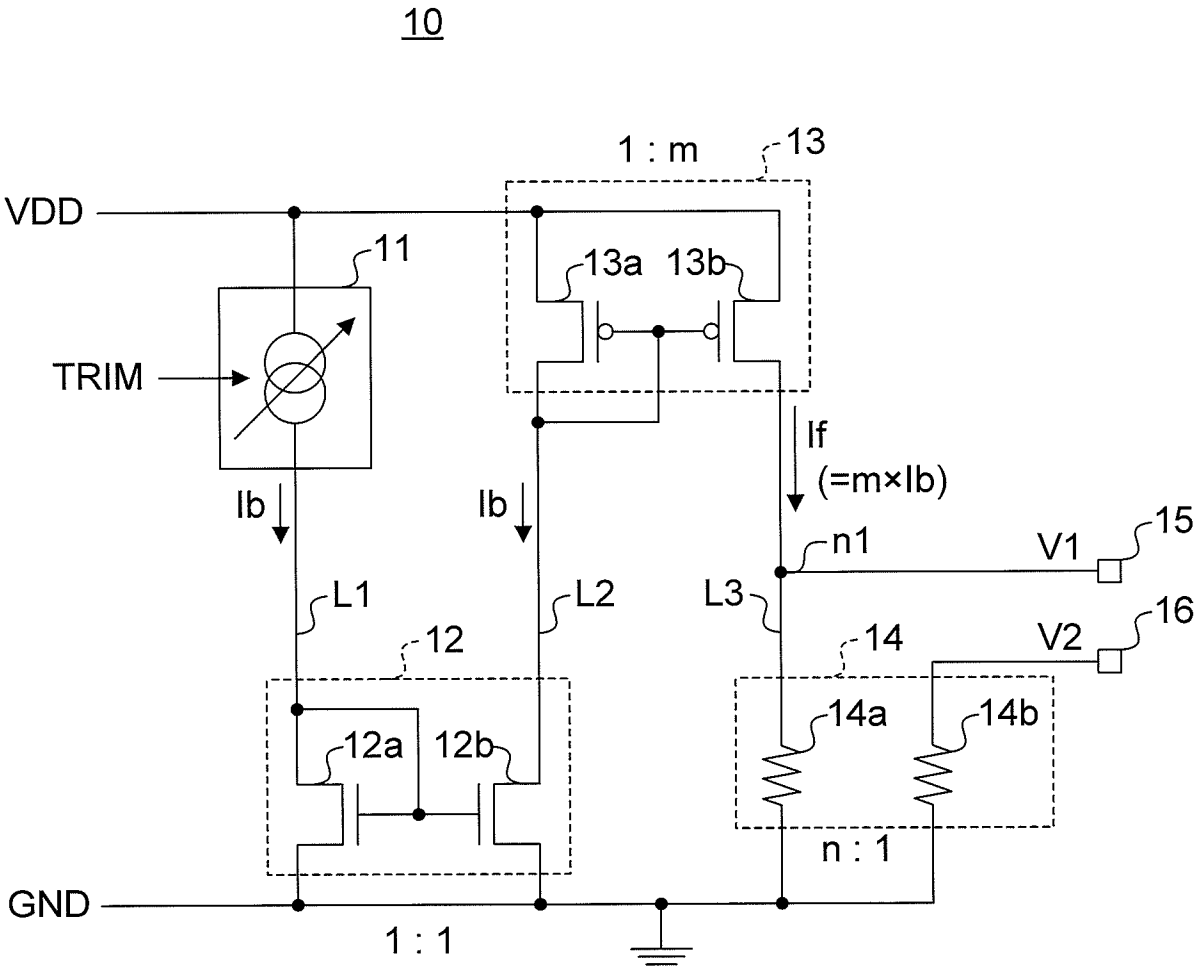
FIG. 1 is a circuit diagram showing a configuration of an adjustable reference current generator 10.

FIG. 1 is a circuit diagram showing a configuration of an adjustable reference current generator 10. The adjustable reference current generator 10 is formed in a semiconductor IC.

The adjustable reference current generator 10 includes a reference current generation part 11, a first current mirror unit 12, a second current mirror unit 13, a resistance part 14, a first terminal 15 and a second terminal 16.

The reference current generation part 11 generates a reference current Ib, and then supplies the reference current Ib to a line L1. The reference current Ib is used by other circuit blocks (not shown) in the semiconductor IC. The reference current generation part 11 receives an adjustment signal TRIM supplied from other circuit blocks in the semiconductor IC. The reference current generation part 11 adjusts an actual current value of the reference current Ib in response to the adjustment signal TRIM. The adjustment signal TRIM is a signal representing a target value of the reference current Ib.

Figure 2:
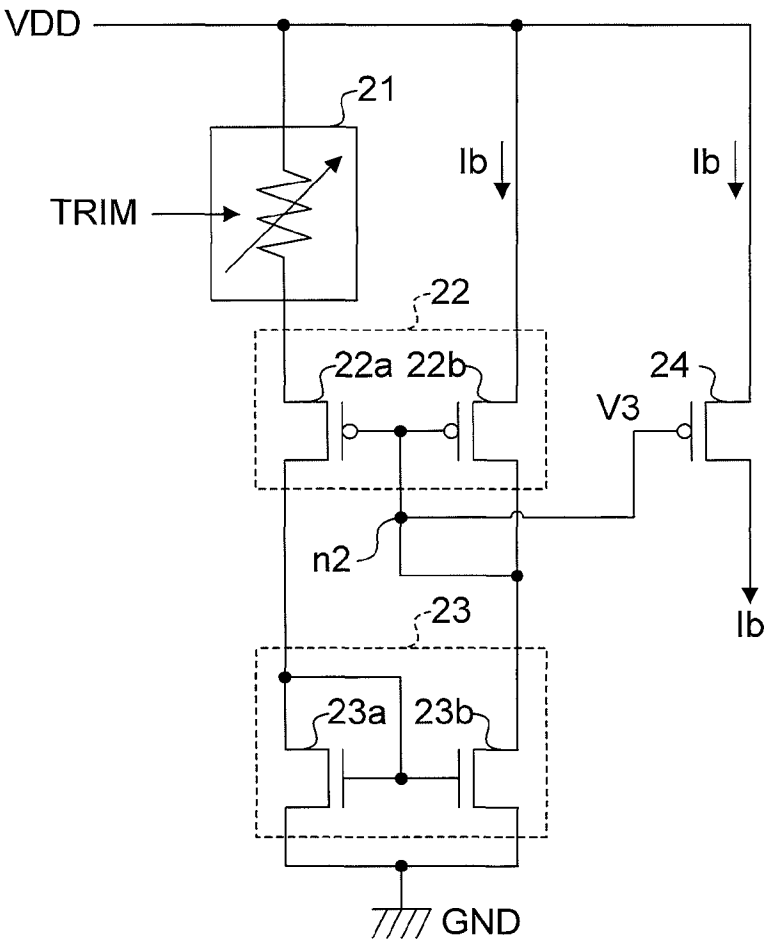
FIG. 2 is a circuit diagram showing a configuration of a reference current generation part 11.

FIG. 2 is a circuit diagram showing a configuration of the reference current generation part 11. The reference current generation part 11 includes a variable resistor 21, a third current mirror unit 22, a fourth current mirror unit 23 and a transistor 24.

The variable resistor 21 changes a resistance value in response to the adjustment signal TRIM. The variable resistor 21 is provided between a power supply VDD and a transistor 22 which constitutes the third current mirror unit 22.

Figures 3A, 3B:
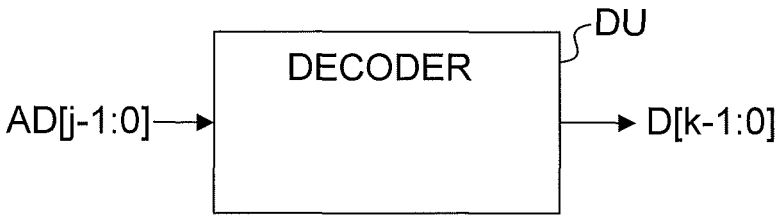
FIGS. 3A and 3B are diagrams schematically showing a decoder and an adjustment signal.

The variable resistor 21 includes a decoder DU as shown in FIG. 3A. The decoder DU converts the adjustment signal TRIM which is a j-bit signal (where the j denotes an integer of 2 or more) into a k-bit signal (where the k denotes 2 to the j-th power). As shown in FIG. 3B, a j-bit signal which has signal values "0" or "1" at each of j bit digits (shown as AD[j−1:0]) is converted into a k-bit signal which has a signal value "1" at only one bit digit and a signal value "0" at each of the other (k−1) bit digits (shown as D[k−1:0]).

Figure 4:
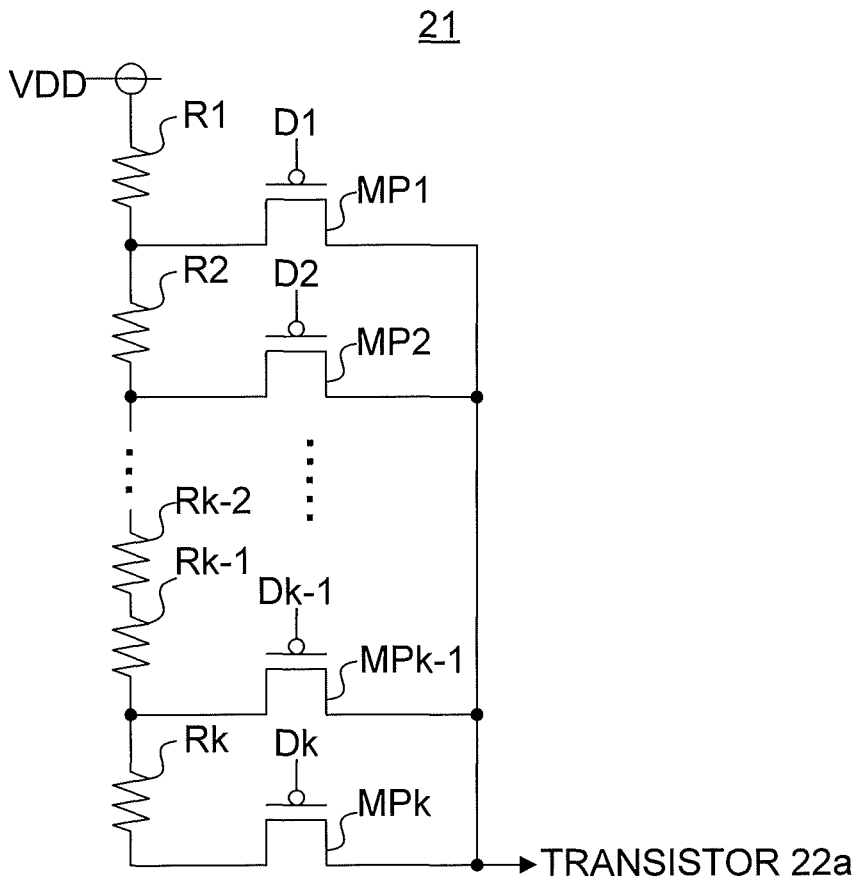
FIG. 4 is a circuit diagram showing a configuration of a variable resistor 21.

The variable resistor 21 includes resistors R1~Rk connected in series and P channel MOS (Metal oxide semiconductor) type transistors MP1~MPk connected in parallel, as shown in FIG. 4. A gate terminal of the transistor MP1 is supplied with a signal D1 having a signal value which is equal to a first bit digit of the adjustment signal which was converted into a k bit signal. A gate terminal of the transistor MP2 is supplied with a signal D2 having a signal value which is equal to a second bit digit of the adjustment signal which was converted into a k bit signal. In the same manner, a gate terminal of transistor MPx (where the x denotes 1~k) is supplied with a signal Dx having a signal value which is equal to x-th bit digit of the adjustment signal which was converted into a k-bit signal.

For example, in case where the signal value of the first bit digit of the adjustment signal TRIM which is converted into a k-bit signal is "1", only the transistor MP1 turns on. As a result, a resistance value of R1 becomes equal to a resistance value of the variable resistor 21. In case where the signal value of the second bit digit of the adjustment signal TRIM which is converted into a k-bit signal is "1", only the transistor MP2 turns on. As a result, the sum of resistance values of R1 and R2 becomes equal to a resistance value of the variable resistor 21. In the same manner, in case where the signal value of the x-th bit digit of the adjustment signal TRIM which is converted into a k-bit signal is "1", only the transistor MPx turns on. As a result, the sum of resistance values of R1, . . . Rx−1 and Rx becomes equal to a resistance value of the variable resistor 21.

The third current mirror unit 22 comprises P channel MOS type transistors 22*a* and 22*b*, as shown in FIG. 2. A source terminal of the transistor 22*b* is connected to a first voltage VDD. A gate terminal and a drain terminal of the transistor 22*b* are in diode-connected. Gate terminals of the transistor 22*a* and 22*b* are connected to each other and supply a gate terminal of a transistor 24 with a gate voltage V3 via a node n2.

The fourth current mirror unit 23 comprises N channel MOS type transistors 23*a* and 23*b*. A gate terminal and a drain terminal of the transistor 23*a* are in diode-connected. Gate terminals of the transistor 23*a* and 23*b* are connected to each other. Source terminals of the transistor 23*a* and 23*b* are connected to the ground potential. A drain terminal of the transistor 23*a* is connected to a drain terminal of the transistor 22*a*. A drain terminal of the transistor 23*b* is connected to a drain terminal of the transistor 22*b*.

The transistor 24 is a P channel MOS type transistor. The transistor 24 becomes a conduction state in response to the gate voltage V3, and supplies the line L1 with the reference current Ib.

The first current mirror unit 12 includes N channel MOS type transistors 12*a* and 12*b* as shown in FIG. 1. A gate terminal and a drain terminal of the transistor 12 are in diode-connected. Gate terminals of the transistors 12*a* and 12*b* are connected to each other. Source terminals of the transistors 12*a* and 12*b* are connected to the ground potential. The transistor 12*a* and 12*b* compose a current mirror circuit having 1:1 current ratio. The first current mirror unit 12 supplies a line L2 with the reference current Ib flowing through the line L1.

The second current mirror unit 13 includes P channel MOS type transistors 13*a* and 13*b*. A gate terminal and a drain terminal of the transistor 13*a* are in diode-connected. Gate terminals of the transistor 13*a* and 13*b* are connected to each other. The power supply VDD is applied to source terminals of the transistor 13*a* and 13*b*. The transistors 13*a* and 13*b* compose a current mirror circuit having 1:m (where the m denotes greater than 1) current ratio (for example, 1:10). The second current mirror unit 13 is a detection current generation part which supplies a line L3 with a detection current If having a current value which is m times (for example, 10 times) as large as a current value of the reference current flowing through the line L2 (m×Ib; for example, 10×Ib).

The resistance part 14 includes a detection resistor 14*a* and a monitor resistor 14*b*. One end of the detection resistor 14*a* is connected to the first terminal 15 via a node n1. The other end of the detection resistor 14*a* is connected to the ground potential. One end of the monitor resistor 14*b* is connected to the second terminal 16. The other end of the monitor resistor 14*b* is connected to the ground potential. The detection resistor 14*a* and the monitor resistor 14*b* have n:1 (where the n denotes greater than 1) resistance ratio (for example, 50:1).

The detection resistor 14*a* is a detection voltage generation part which generates a first voltage V1 as a detection voltage having a voltage value corresponding to a voltage drop, in response to the detection current If. On the other hand, the monitor resistor 14*b* is a monitor voltage generation part which generates a second voltage V2 as a monitor voltage, which has a voltage corresponding to a voltage drop, in response to a monitor current Io supplied from the outside of the semiconductor IC.

Figure 5:
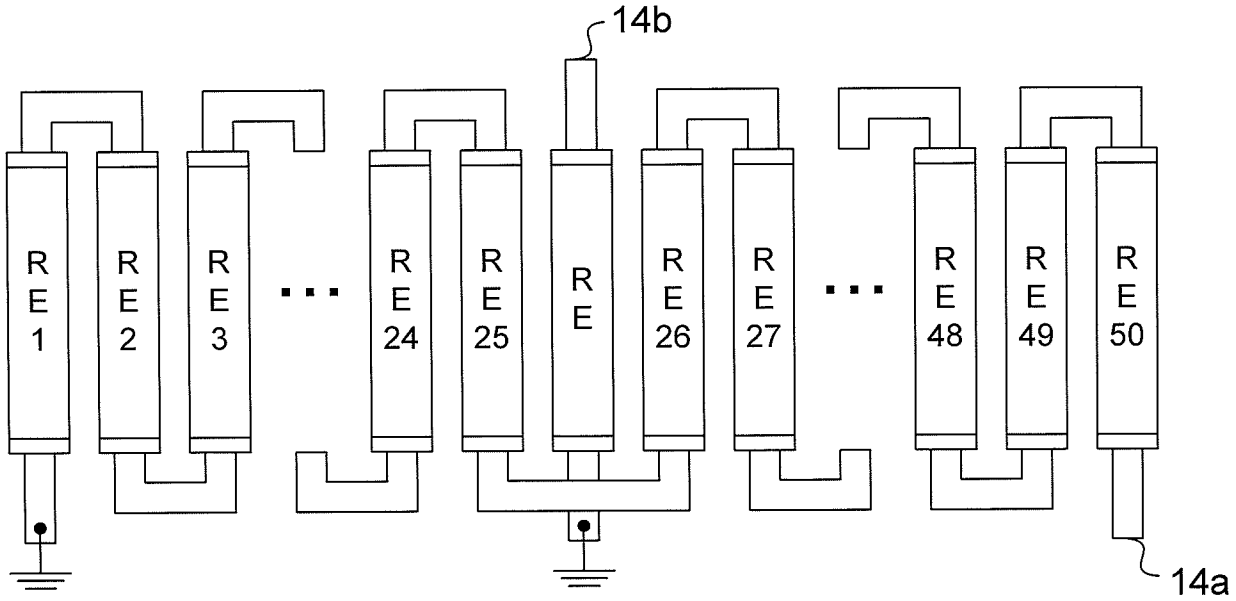
FIG. 5 is a circuit diagram showing a configuration of a resistance part 14.
Figure 6:
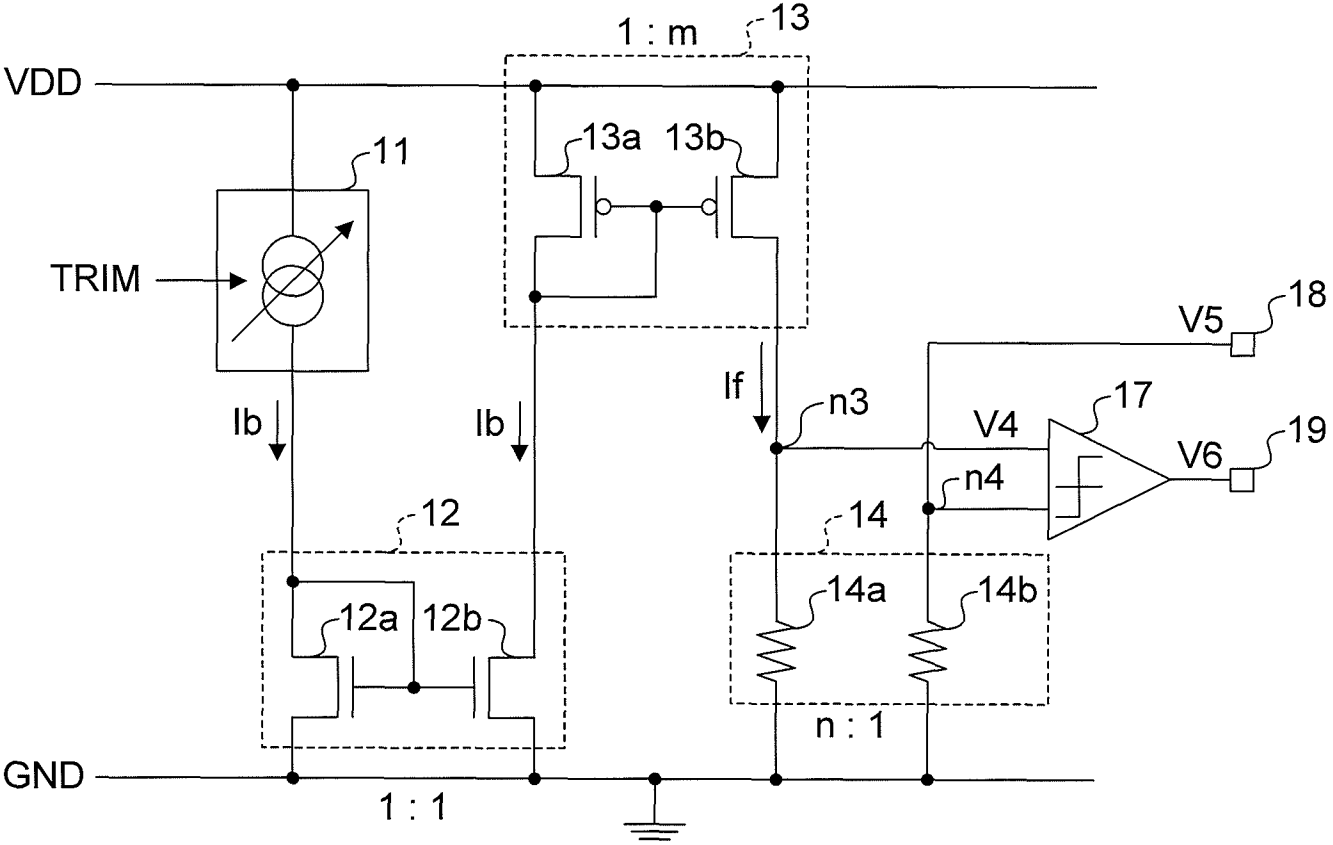
FIG. 6 is a circuit diagram showing a configuration of an adjustable reference current generator 19 of example 2.

FIG. 5 is a circuit diagram showing an example of a configuration of the resistance part 14. The resistance part 14 comprises 2 kinds of resistors, the detection resistor 14*a* which is consisting of resistance element group being composed of 50 resistance elements RE1~RE50 connected in series, and a monitor resistor 14*b* which is consisting of a resistance element RE. The resistance element RE and the resistance elements RE1~RE50 are manufactured in the same process and have the same resistance value. The resistance ratio of the detection resistor 14*a* and the monitor resistor 14*b* depends on the number ratio of the resistance elements. The resistance ratio of the detection resistor 14*a* and the monitor resistor 14*b* is kept substantially constant at n:1 (for example, 50:1), even if the variation occurs in a resistance value of each of the resistance elements comprising the detection resistor 14*a* and the monitor resistor 14*b*.

The monitor resistor 14*b* is located in the center position of the resistance elements composing the detection resistor 14*a* as shown in FIG. 5, for example. The resistance element group constituting the detection resistor 14*a* is composed of the resistance elements RE1~RE50 in which the neighboring ones are connected in series with each other by wiring. The wiring in the center position is provided so as to cross the monitor resistor 14*b*. Since the resistance elements are constructed and arranged in such a manner, resistance ratio of the detection resistor 14*a* and the monitor resistor 14*b* is kept substantially constant. As a result, a resistance value of the detection resistor 14*a* can be obtained accurately by obtaining a resistance value of the monitor resistor 14*b*.

The first terminal 15 outputs the first voltage V1 having a voltage value which is corresponding to the voltage drop in the detection resistor 14*a*, as shown in FIG. 1. For example, if a resistance value of the detection resistor is 10 MΩ and a current value of the reference current Ib is 10 nA, the detection current If having a current value which is m×10 nA (for example, 10×10 nA) flows through the line 3. As a result, the first voltage V1 having a current value which is m×0.1 V (for example, 100 nA×10 MΩ=1V) is output from the first terminal 15.

The second terminal 16 receives the monitor current Io supplied from the outside of the semiconductor IC, and supplies the monitor resistor 14*b* with the monitor current Io. The second terminal 16 outputs the second voltage V2 having a current value corresponding to a voltage drop across the monitor resistor 14*b*.

Then, measurement process of a resistance value of the detection resistor 14*a* which is the detection voltage generation part, and measurement process of a current value of the reference current Ib are described below. The case where n=50 and m=10 is explained as an example in the following description.

[Measurement of a Resistance Value]

First of all, depending on the supply of the monitor current Io to the second terminal 16, a voltage value of the second voltage V2 is measured. As a result, a resistance value of the monitor resistor 14*b* is obtained. For example, if a current value of the monitor current is 5 μA and a voltage value of the second voltage V2 is 1 V, a resistance value of the monitor resistor 14*b* is obtained as 200 kΩ.

Resistance ratio between the detection resistor 14*a* and the monitor resistor 14*b* is 50:1. Therefore, a resistance value of the detection resistor 14*b* is calculated on the basis of a resistance value of the monitor resistor 14*b*. For example, if a resistance value of the monitor resistor 14*b* is 200 kΩ, a resistance value of the detection resistor 14*a* is determined as 10 MΩ.

By the above processing, a resistance value of the detection resistor 14*a* is obtained. A resistance value of the detection resistor 14*a* is not measured directly, but calculated on the basis of a resistance value of the monitor resistor 14*b*. As a result, a resistance value of the detection resistor 14*a* can be obtained by supplying the monitor current Io which is relatively small, even if a resistance value is large. Therefore, a resistance value of the detection resistor 14*a* (that is, a resistance value of the detection voltage generation part) is obtained easily and accurately.

[Measurement of a Current Value]

A voltage value of the first voltage V1 output from the first terminal 15 is measured. An instantaneous current value of the current flowing through the line L3 is obtained on the basis of the measured voltage and a resistance value of the detection resistor 14*a*. For example, if the measured voltage value of the first voltage V1 is 1V and a resistance value of the detection resistor 14*a* is 10 MΩ, an instantaneous current value of the detection current If flowing through the line L3 is obtained as 100 nA.

A current value of the detection current If is 10 times as large as a current value of the reference current Ib. Therefore, an actual current value of the reference current Ib is obtained on the basis of a current value of the detection current If. For example, if a current value of the detection current If is 100 nA, a current value of the reference current Ib is obtained as 10 nA.

By the above processing, an actual current value of the reference current Ib is obtained on the basis of a current value of the first voltage V1. A voltage value of the first voltage V1 is corresponding to a current value which is 10 times as large as a current value of the reference current Ib. As a result, it becomes easy to change a resistance value of the variable resistor 21 provided in the reference current generation part 11 and to adjust a current value of the reference current Ib by changing the signal value of the adjustment signal TRIM while measuring a voltage value of the first voltage V1. Therefore, it is realized to adjust an actual current value of the reference current to a nominal one while measuring the actual current value of the reference current easily and accurately, even if the reference current is small, for example such as nano-order.

Example 2

An adjustable reference current generator 10 in the example 2 includes a reference current generation part 11, a first current mirror unit 12, a second current mirror unit 13, a resistance part 14, a comparator 17, a monitor terminal 18 and a comparator output terminal 19. The configurations of the reference current generation part 11, the first current mirror unit 12, the second current mirror unit 13 and the resistance part 14 are the same as those of the example 1.

One of the input terminals of the comparator 17 is connected to a transistor 13*b* and a detection resistor 14*a* via a node n3. The other of the input terminals is connected to the monitor terminal 18 and a monitor resistor 14*b* via a node n4. The comparator 17 outputs a result of comparison between a detection voltage V4 which is supplied via the node n3 and a monitor voltage V5 which is supplied via the node n4, as an output voltage V6 via the comparator output terminal 19.

The monitor terminal 18 receives a monitor current Io supplied from the outside of the semiconductor IC, and supplies the monitor resistor 14*b* with the monitor current Io, and outputs the monitor voltage V5. The monitor current Io is a current having a current value which is m×n times (for example, in the case of m=10 and n=50, it is 5000 times) as large as a target value of the reference current.

Measurement processes of a resistance value of the detection resistor 14*a* which is a detection voltage generation part and an actual current value of the reference current Ib are described below. In the following description, the case of n=50, m=10 is described as an example.

[Measurement of a Resistance Value]

First of all, the monitor current Io is supplied to the monitor terminal 18. The monitor current Io is a current having a current value which is 500 times as large as a target current value of the reference current Ib. For example, if the target current value of the reference current Ib is 10 nA, the monitor current Io having a current value of 5 ρA is required to be supplied to a second terminal 16.

A resistance value of the monitor resistor 14*b* is obtained on the basis of a voltage value of the monitor voltage V5 which is output from the monitor terminal 18. For example, if a current value of the monitor current Io is 5 ρA and a voltage value of the monitor voltage V5 is 1V, a resistance value of the monitor resistor 14*b* is determined as 200 kΩ.

The detection resistor 14*a* and the monitor resistor 14*b* are at 50:1 resistance ratio. For example, if a resistance value of the monitor resistor 14*b* is 200 kΩ, a resistance value of the detection resistor 14*a* is determined as 10 MΩ.

[Measurement of a Current Value]

The detection voltage V4 corresponding to a voltage drop across the detection resistor 14*a* is applied to the comparator 17. A voltage value of the detection voltage V4 is obtained by the product of a current value of the detection current If which is 10 times as large as a current value of the reference current Ib (that is, 10×Ib) and a resistance value of the detection resistor 14*a* (for example, 10 MΩ).

On the other hand, the monitor current Io flows through the monitor resistor 14*b*. As a result, the monitor voltage V5 having a voltage value corresponding to a voltage drop across the monitor resistor 14*b* occurs at the node n4 and is supplied to the comparator 17 and the monitor terminal 18. A voltage value of the monitor voltage V5 is equal to the target voltage value of the detection voltage V4. A current having a current value which is 10 times as large as the reference current flows through the detection resistor 14*a*. A resistance value of the detection resistor 14*a* is 50 times as large as a resistance value of the monitor resistor 14*b*. Therefore, a voltage value of the detection voltage V4 becomes equal to a voltage value of the monitor voltage V5, when a current value of the reference current Ib matches with the target current value.

The comparator 17 outputs an output voltage V6 indicating a result of comparison between the detection voltage V4 and the monitor voltage V5.

An adjustment is performed by changing the signal value of the adjustment signal step by step so that the output voltage V6 becomes 0 while measuring the output voltage V6 obtained by the above processing. An actual current value of the reference current Ib is adjusted to the target current value by changing a resistance value of the variable resistor 21 in the reference current generation part 11.

By an adjustable reference current generator according to the present invention, an adjustment is performed so that an output voltage (V6) becomes 0. Therefore, measurement and adjustment of a current value of a reference current are performed easily and accurately.

As described above, an adjustable reference current generator (10) according to the present invention includes a monitor resistor (14*b*) having a resistance value which is smaller than a resistance value of a detection resistor (14*a*) and is at constant resistance ratio against the resistance value of the detection resistor (14*a*). The resistance value of the detection resistor (14*a*) can be obtained by measuring a voltage drop based on supplying the monitor resistor (14*b*) with a monitor current (Io) and calculating the resistance value of the monitor resistor (14*b*) on the basis of the result of the measurement. Therefore, a resistance value of a detection voltage generation part can be obtained easily and accurately, even if the resistance value of the detection resistor (14*a*) is large.

The adjustable reference current generator according to the present invention includes a second current mirror unit (13) as a detection current generation part which generates a detection current (If) having a current value which is m times as large as a current value of a reference current (Ib). The detection resistor 14*a* generates a first voltage (V1) (that is, a detection voltage) on the basis of the detection current (If). For example, if the m is greater than 1, a small current value of the reference current (Ib) is observed as a large voltage value. Therefore, it becomes possible to adjust a current value of the reference current while measuring a current value of the reference current easily and accurately.

Embodiments of the present invention are not limited by the foregoing Examples. For example, in the foregoing Examples, a circuit operation is described about a case where the resistance ratio between the detection resistor 14*a* and the monitor resistor 14*b* is 50:1. However, the resistance ratio is not limited to the above. The resistance ratio between the detection resistor 14*a* and the monitor resistor 14*b* is not limited to the above, and may be n:1 (where the n denotes greater than 1). The monitor resistor 14*b* may be the one having a resistance value which is 1/n times as large as a resistance value of the detection resistor 14*a*.

In the foregoing Examples, it is described about a case where the detection resistor 14*a* consists of a plurality of resistance elements RE connected in series which also compose a monitor resistor 14*b*. However, the configuration of the detection resistor 14*a* is not limited to this. The detection resistor 14*a* and the monitor resistor 14*b* may be the ones which have constant resistance ratio by being manufactured in the same process or the like.

In the foregoing Examples, a circuit operation is described about a case where the second current mirror unit 13 generates a detection current If having a current value which is 10 times as large as a current value of the reference current Ib. However, a current value of the detection current If is not limited to this. The second current mirror unit 13 may be the one which generates a detection current If having a current value which is m times (where the m denotes 1 or more) as large as a current value of the reference current Ib.

The first current mirror unit 12 and the second current mirror unit 13 may be connected in cascode. According to this configuration, current fluctuation is suppressed. Since the accuracy of a current ratio is improved, measurement of the reference current and an adjustment are made with a high accuracy.

The adjustable reference generator (10) comprises a reference current generation part for receiving an adjustment signal (TRIM) representing a target current and generating a reference current (Ib) having a current value which is corresponding to the adjustment signal, a detection current generation part (13) for generating a detection current having a current value which is m (where the m denotes 1 or more) times as large as a current value of the reference current, a detection voltage generation part (14*a*) with a first resistor for generating a detection voltage (V1) having a voltage value which is corresponding to a voltage drop across the first resistor in response to a supply of the detection current, a monitor voltage generation part (14*b*) with a second resistor having a resistance value which is 1/n (where the n denotes greater than 1) times as large as a resistance value of the first resistor for generating a monitor voltage (V2) having a voltage value which is corresponding to a voltage drop across the second resistor in response to a monitor current (Io) supplied from outside of the adjustable reference current generator.

What is claimed is:

1. An adjustable reference current supplier for supplying a reference current with an instantaneous value varying in accordance with an adjustment signal representing a target current comprising:

a reference current generation part for generating a reference current having a current value corresponding to said adjustment signal supplied thereto, a detection current generation part for generating a detection current having a current value which is m (where the m denotes 1 or more) times as large as a current value of said reference current, a detection voltage generation part with a first resistor for generating a detection voltage having a voltage value corresponding to a voltage drop across said first resistor in response to said detection current, a monitor voltage generation part including a second resistor having a resistance value which is 1/n (where the n denotes greater than 1) times as large as a resistance value of said first resistor and a terminal to which an external monitor current is suppliable, and for generating a monitor voltage having a voltage value which value corresponds to a voltage drop across said second resistor in response to said monitor current supplied thereto.

2. The adjustable reference current supplier according to claim 1, wherein said detection current generation part amplifies said reference current and generates said detection current having a current value which is m (where the m denotes greater than 1) times as large as a current value of said reference current.

3. The adjustable reference current supplier according to claim 1, wherein:

said n denotes an integer of 2 or more, said second resistor includes at least one resistance piece, said first resistor includes a plurality of resistance pieces having a common resistance value and connected in series, said common resistance value is equal to a resistance value of said resistance piece included in said second resistor, and the number of said resistance pieces included in said first resistor is equal to n times as large as the number of said resistance pieces included in said second resistor.

4. The adjustable reference current supplier according to claim 1, further comprising:

a comparison voltage output part for outputting a comparison voltage having a voltage which is corresponding to a potential difference between said detection voltage and said monitor voltage.

5. The adjustable reference current supplier according to claim 1, wherein said reference current generation part includes a variable resistor which varies resistance value in response to said adjustment signal, and generates said reference current on the basis of the power supply potential and the resistance value of said variable resistor.

6. A semiconductor device comprising an adjustable reference current supplier for supplying a reference current with an instantaneous value varying in accordance with an adjustment signal representing a target current, said adjustable reference current supplier comprising:

a reference current generation part for generating a reference current having a current value which is corresponding to said adjustment signal supplied thereto, a detection current generation part for generating a detection current having a current value which is m (where the m denotes 1 or more) times as large as a current value of said reference current, a detection voltage generation part with a first resistor for generating a detection voltage having a voltage value corresponding to a voltage drop across said first resistor in response to said detection current, a monitor voltage generation part including a second resistor having a resistance value which is 1/n (where the n denotes greater than 1) times as large as a resistance value of said first resistor and a terminal to which an external monitor current is suppliable, and for generating a monitor voltage having a voltage value which value corresponds to a voltage drop across said second resistor in response to said monitor current supplied thereto.

7. The semiconductor device according to claim 6, wherein said detection current generation part amplifies said reference current and generates said detection current having a current value which is m (where the m denotes greater than 1) times as large as a current value of said reference current.

8. The semiconductor device according to claim 6, wherein;

said n denotes an integer of 2 or more, said second resistor includes at least one resistance piece, said first resistor includes a plurality of resistance pieces having a common resistance value and connected in series, said common resistance value is equal to a resistance value of said resistance piece included in said second resistor, and the number of said resistance pieces included in said first resistor is equal to n times as large as the number of said resistance pieces included in said second resistor.

9. The semiconductor device according to claim 6, wherein said adjustable reference current generator further comprising:

a comparison voltage output part for outputting a comparison voltage having a voltage which is corresponding to a potential difference between said detection voltage and said monitor voltage.

10. The semiconductor device according to claim 6, wherein said reference current generation part includes a variable resistor which varies resistance value in response to said adjustment signal, and generates said reference current on the basis of the power supply potential and the resistance value of said variable resistor.

11. The adjustable reference current supplier according to claim 1, wherein said first resistor and said second resistor are connected to each other at one end.

12. The adjustable reference current supplier according to claim 6, wherein said first resistor and said second resistor are connected to each other at one end.

* * * * *